US009843105B2

(12) United States Patent
Wang et al.

(10) Patent No.: US 9,843,105 B2
(45) Date of Patent: Dec. 12, 2017

(54) INTEGRATED STRIPLINE FEED NETWORK FOR LINEAR ANTENNA ARRAY

(71) Applicants: Nan Wang, Shang Hai (CN); Orville Nyhus, Glendale, AZ (US); Charles Wang, Shanghai (CN)

(72) Inventors: Nan Wang, Shang Hai (CN); Orville Nyhus, Glendale, AZ (US); Charles Wang, Shanghai (CN)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 13/879,300

(22) PCT Filed: Feb. 8, 2013

(86) PCT No.: PCT/CN2013/071565
§ 371 (c)(1),
(2) Date: Apr. 12, 2013

(87) PCT Pub. No.: WO2014/121515
PCT Pub. Date: Aug. 14, 2014

(65) Prior Publication Data

US 2015/0333411 A1 Nov. 19, 2015

(51) Int. Cl.
*H01Q 21/00* (2006.01)
*H01Q 1/12* (2006.01)
(Continued)

(52) U.S. Cl.
CPC ..... *H01Q 21/0075* (2013.01); *H01Q 1/12* (2013.01); *H01Q 1/246* (2013.01); *H01Q 3/26* (2013.01); *H01Q 21/08* (2013.01); *H01Q 21/205* (2013.01)

(58) Field of Classification Search
CPC ..... H01Q 21/22; H01Q 21/0043; H01Q 3/40; H01Q 3/32; H01P 5/16; H01P 5/085; H01P 5/12
(Continued)

(56) References Cited

U.S. PATENT DOCUMENTS 2,227,563 A * 1/1941 Werndl ..... H01Q 3/32 333/100
2,539,433 A 1/1951 Kandoian et al.
(Continued)

FOREIGN PATENT DOCUMENTS

CH CN 102195143 A * 9/2011 ..... H03K 5/01
CH CN 103152015 A * 6/2013 ..... H03K 5/01
(Continued)

OTHER PUBLICATIONS

State Intellectual Property Office, The P.R. China, "International Search Report and Written Opinion", "from PCT Counterpart of U.S. Appl. No. 13/879,300", dated Nov. 21, 2013, pp. 1-11.
(Continued)

*Primary Examiner* — Dieu H Duong
*Assistant Examiner* — Bamidele A Jegede
(74) *Attorney, Agent, or Firm* — Fogg & Powers LLC

(57) ABSTRACT

An embodiment of an integrated stripline feed network for a linear antenna array comprises a power distribution network coupled to the linear antenna array; a feed signal input/output component coupled to the power distribution network; wherein the input/output component receives a feed signal and splits the feed signal for distributing to a plurality of antenna elements of the linear antenna array through the power distribution network. The integrated stripline feed network is configured to be integrated into a support body of the linear antenna array, wherein, the support body structurally supports the linear antenna array.

16 Claims, 5 Drawing Sheets

(51) Int. Cl.

| | |
|---|---|
| ***H01Q 21/08*** | (2006.01) |
| ***H01Q 3/26*** | (2006.01) |
| ***H01Q 21/20*** | (2006.01) |
| ***H01Q 1/24*** | (2006.01) |

(58) Field of Classification Search
USPC ..... 333/128, 116, 100, 238, 117; 343/725, 343/795, 853
See application file for complete search history.

(56) References Cited

U.S. PATENT DOCUMENTS

| | | | | |
|---|---|---|---|---|
| 2,939,143 | A | 10/1954 | Zisler | |
| 2,757,369 | A | 7/1956 | Darling | |
| 3,329,959 | A | 7/1967 | Laub et al. | |
| 3,413,644 | A | 11/1968 | Laub et al. | |
| 3,604,010 | A | 9/1971 | Schwartz et al. | |
| 4,021,813 | A | 5/1977 | Black et al. | |
| 4,083,051 | A | 4/1978 | Woodward | |
| 4,090,203 | A * | 5/1978 | Duncan | H01Q 21/22 343/753 |
| 4,160,976 | A | 7/1979 | Conroy | |
| 4,262,265 | A | 4/1981 | Nygren et al. | |
| 4,383,226 | A * | 5/1983 | Nygren | H01P 5/085 333/238 |
| 4,446,465 | A * | 5/1984 | Donovan | H01Q 21/24 343/797 |
| 4,590,480 | A * | 5/1986 | Nikolayuk | H01Q 21/0043 343/725 |
| 4,614,947 | A | 9/1986 | Rammos | |
| 4,973,972 | A | 11/1990 | Huang | |
| 4,980,692 | A | 12/1990 | Rudish et al. | |
| 5,061,943 | A | 10/1991 | Rammos | |
| 5,291,211 | A * | 3/1994 | Tropper | H01Q 21/205 343/700 MS |
| 5,471,181 | A | 11/1995 | Park | |
| 5,534,882 | A | 7/1996 | Lopez | |
| 5,784,032 | A | 7/1998 | Johnston et al. | |
| 5,789,996 | A * | 8/1998 | Borodulin | H01P 5/12 333/117 |
| 5,861,858 | A | 1/1999 | Niekamp | |
| 5,999,145 | A | 12/1999 | Niekamp | |
| 6,043,722 | A * | 3/2000 | Vaninetti | H01P 1/184 333/128 |
| 6,201,510 | B1 | 3/2001 | Lopez et al. | |
| 6,249,261 | B1 | 6/2001 | Solberg, Jr. et al. | |
| 6,366,185 | B1 | 4/2002 | Keesey et al. | |
| 6,384,788 | B2 | 5/2002 | Pretorius et al. | |
| 6,437,740 | B1 | 8/2002 | De Champlain et al. | |
| 6,452,562 | B1 | 9/2002 | Nyhus | |
| 6,480,167 | B2 * | 11/2002 | Matthews | H01Q 3/40 343/795 |
| 6,608,601 | B1 | 8/2003 | Collinson et al. | |
| 6,621,469 | B2 | 9/2003 | Judd et al. | |
| 6,640,085 | B1 | 10/2003 | Chatzipetros et al. | |
| 6,697,029 | B2 | 2/2004 | Teillet et al. | |
| 6,717,555 | B2 | 4/2004 | Teillet et al. | |
| 6,727,777 | B2 | 4/2004 | McDonough et al. | |
| 6,885,343 | B2 | 4/2005 | Roper | |
| 7,075,497 | B2 | 7/2006 | Teillet et al. | |
| 7,119,757 | B1 | 10/2006 | Lopez | |
| 7,417,597 | B1 | 8/2008 | Lopez | |
| 7,427,962 | B2 | 9/2008 | Yang | |
| 7,839,235 | B2 * | 11/2010 | Xiong | H01Q 3/40 333/116 |
| 8,049,667 | B2 | 11/2011 | Lackey | |
| 8,154,466 | B2 | 4/2012 | Lewis et al. | |
| 8,164,532 | B1 | 4/2012 | Brown et al. | |
| 8,217,839 | B1 | 7/2012 | Paulsen | |
| 8,217,850 | B1 | 7/2012 | Jennings et al. | |
| 2002/0126062 | A1 * | 9/2002 | Matthews | H01Q 3/40 343/795 |
| 2002/0158808 | A1 | 10/2002 | Inoue | |
| 2004/0038714 | A1 | 2/2004 | Rhodes et al. | |
| 2004/0048420 | A1 | 3/2004 | Miller | |
| 2004/0056819 | A1 | 3/2004 | McCarthy et al. | |
| 2005/0088337 | A1 | 4/2005 | Lorenz | |
| 2005/0110699 | A1 | 5/2005 | Timofeev et al. | |
| 2005/0168301 | A1 | 8/2005 | Carson | |
| 2007/0046393 | A1 * | 3/2007 | Quan | H01P 5/16 333/128 |
| 2007/0285334 | A1 | 12/2007 | Tsutsumi et al. | |
| 2008/0246684 | A1 | 10/2008 | Fujishima et al. | |
| 2009/0278761 | A1 | 11/2009 | Makinen et al. | |
| 2010/0141530 | A1 | 6/2010 | McMahon | |
| 2010/0207811 | A1 | 8/2010 | Lackey | |
| 2011/0063171 | A1 | 3/2011 | Lopez | |
| 2012/0038530 | A1 | 2/2012 | Chen et al. | |
| 2012/0188137 | A1 | 7/2012 | Lalezari | |
| 2013/0057449 | A1 | 3/2013 | Orihashi et al. | |
| 2013/0059533 | A1 | 3/2013 | Kwon et al. | |
| 2013/0070819 | A1 | 3/2013 | Zhao et al. | |
| 2013/0342280 | A1 | 12/2013 | Blanton et al. | |
| 2015/0200459 | A1 | 7/2015 | Wang et al. | |
| 2015/0200465 | A1 | 7/2015 | Wang et al. | |
| 2015/0201494 | A1 | 7/2015 | Wang et al. | |
| 2015/0311598 | A1 | 10/2015 | Wang et al. | |

FOREIGN PATENT DOCUMENTS

| | | |
|---|---|---|
| CN | 1801530 | 7/2006 |
| CN | 101051860 | 10/2007 |
| CN | 101110499 | 1/2008 |
| CN | 201167136 | 12/2008 |
| CN | 102195143 | 9/2011 |
| DE | 102004063784 | 7/2006 |
| DE | 102005063234 | 6/2007 |
| EP | 0512487 | 5/1992 |
| EP | 2254197 | 11/2010 |
| EP | 2434577 | 3/2012 |
| WO | 2007069809 | 6/2007 |

OTHER PUBLICATIONS

European Patent Office, "Extended European Search Report from EP Application No. 15150863.7 dated May 19, 2015", from Foreign Counterpart of U.S. Appl. No. 14/156,576, dated May 19, 2015, pp. 1-7, Published in: EP.

European Patent Office, "Extended European Search Report from EP Application No. 15150390.1 dated May 21, 2015", from Foreign Counterpart of U.S. Appl. No. 14/154,886, dated May 21, 2015, pp. 1-6, Published in: EP.

Lopez, "GPS Landing System Reference Antenna", IEEE Antennas and Propagation Magazine, Feb. 2010, pp. 104-113, vol. 52, No. 1, Publisher: IEEE.

Varlamos et al., "Electronic Beam Steering Using Switched Parasitic Smart Antenna Arrays", Progress in Electromagnetics Research, Pier 36, 2002, pp. 101-119, Publisher: National Technical Institute of Athens.

European Patent Office, "Extended European Search Report from EP Application No. 15150542.7 dated Jun. 11, 2015", from Foreign Counterpart of U.S. Appl. No. 14/155,920, dated Jun. 11, 2015, pp. 1-11, Published in: EP.

Inclan-Alonso et al., "Low Loss Power Distribution Network in Stripline Technology for Planar Array Antennas", Progress in Electromagnets Research, Nov. 13, 2013, pp. 369-384, vol. 143.

Lopez, "LAAS/GBAS Ground Reference Antenna with Enhanced Mitigation of Ground Multipath", "The Institute of Navigation National Technical Meeting", Jan. 28, 2008, pp. 1-17, Publisher: BAE Systems.

"U.S. Office Action", from U.S. Appl. No. 14/155,920, dated Oct. 7, 2015, Published in: U.S.

"U.S. Notice of Allowance", U.S. Appl. No. 14/155,920, dated Mar. 31, 2016, pp. 1-8.

"U.S. Office Action", U.S. Appl. No. 14/154,886, dated Apr. 7, 2016, pp. 1-26.

European Patent Office, "Office Action from EP Application No. 15150542.7 dated May 23, 2016", from Foreign Counterpart of U.S. Appl. No. 14/155,920, dated May 23, 2016, pp. 1-8, Published in: EP.

(56) References Cited

OTHER PUBLICATIONS

"U.S. Office Action", from U.S. Appl. No. 14/156,576, dated Feb. 1, 2016, pp. 1-28, Published in: U.S.
European Patent Office, "Communication under Rule 71(3)", from U.S. Appl. No. 14/155,920, dated Feb. 6, 2017, pp. 1-27, Published in: EP.
"U.S. Final Office Action", from U.S. Appl. No. 14/154,886, dated Feb. 3, 2017, pp. 1-29, Published in: U.S.
European Patent Office, "Extended European Search Report for EP Application No. 13876746.2", from U.S. Appl. No. 13/978,150, dated Dec. 22, 2016, pp. 1-9, Published in: EP.
"U.S. Office Action", from U.S. Appl. No. 13/978,150, dated Dec. 27, 2016, pp. 1-28, Published in: U.S.
European Patent Office, "European Search Report for EP Application No. 13874608.6", from Foreign counterpart of U.S. Appl. No. 14/154,886, dated Nov. 7, 2016, pp. 1-8, Published in: EP.
State Intellectual Property Office of People's Republic of China, "First Office Action for CN Application No. 201380072511.8", Foreign Counterpart to U.S. Appl. No. 13/879,300, dated Mar. 24, 2017, pp. 1-25, Published in: CN.
"U.S. Final Office Action", from U.S. Appl. No. 13/978,150 dated Jun. 23, 2017, Jun. 23, 2017, pp. 1-22, Published in: U.S.
"U.S. Notice of Allowance", From U.S. Appl. No. 14/154,886, dated Apr. 13, 2017, pp. 1-13, Published in: U.S.

* cited by examiner

INTEGRATED STRIPLINE FEED NETWORK FOR LINEAR ANTENNA ARRAY

BACKGROUND

In known systems, such as ground reference antennas used in Local Area Augmentation Systems (LAAS) and Ground Based Augmentation Systems (GBAS), generally the feed network board is kept outside of the antenna in its own independent box. The feed network then connects to each antenna element through RF cables of a specific length to maintain the same phase delay to each antenna element.

Some current implementations of LAAS/GBAS antenna arrays include several parasitic elements. This increases the cost and complexity of such designs. Feed networks for such antenna arrays are difficult to produce and most feed networks require complex driving boards and numerous phase stable cables to maintain acceptable phase stability. Some current feed networks use microstrip lines and striplines, but issues common to both approaches persist. These issues include the need for enough space in the feed networks to isolate strong and weak signals; coupling the feed network to actual feed lines; and the need for complex assembly processes.

SUMMARY

An embodiment of an integrated stripline feed network for a linear antenna array comprises a power distribution network coupled to the linear antenna array; a feed signal input/output component coupled to the power distribution network; wherein the input/output component receives a feed signal and splits the feed signal for distributing to a plurality of antenna elements of the linear antenna array through the power distribution network. The integrated stripline feed network is configured to be integrated into a support body of the linear antenna array, wherein, the support body structurally supports the linear antenna array.

DRAWINGS

Understanding that the drawings depict only exemplary embodiments and do not limit the scope of the invention, the exemplary embodiments will be described with additional specificity and detail through the use of the accompanying drawings, in which.

Figure 1A:
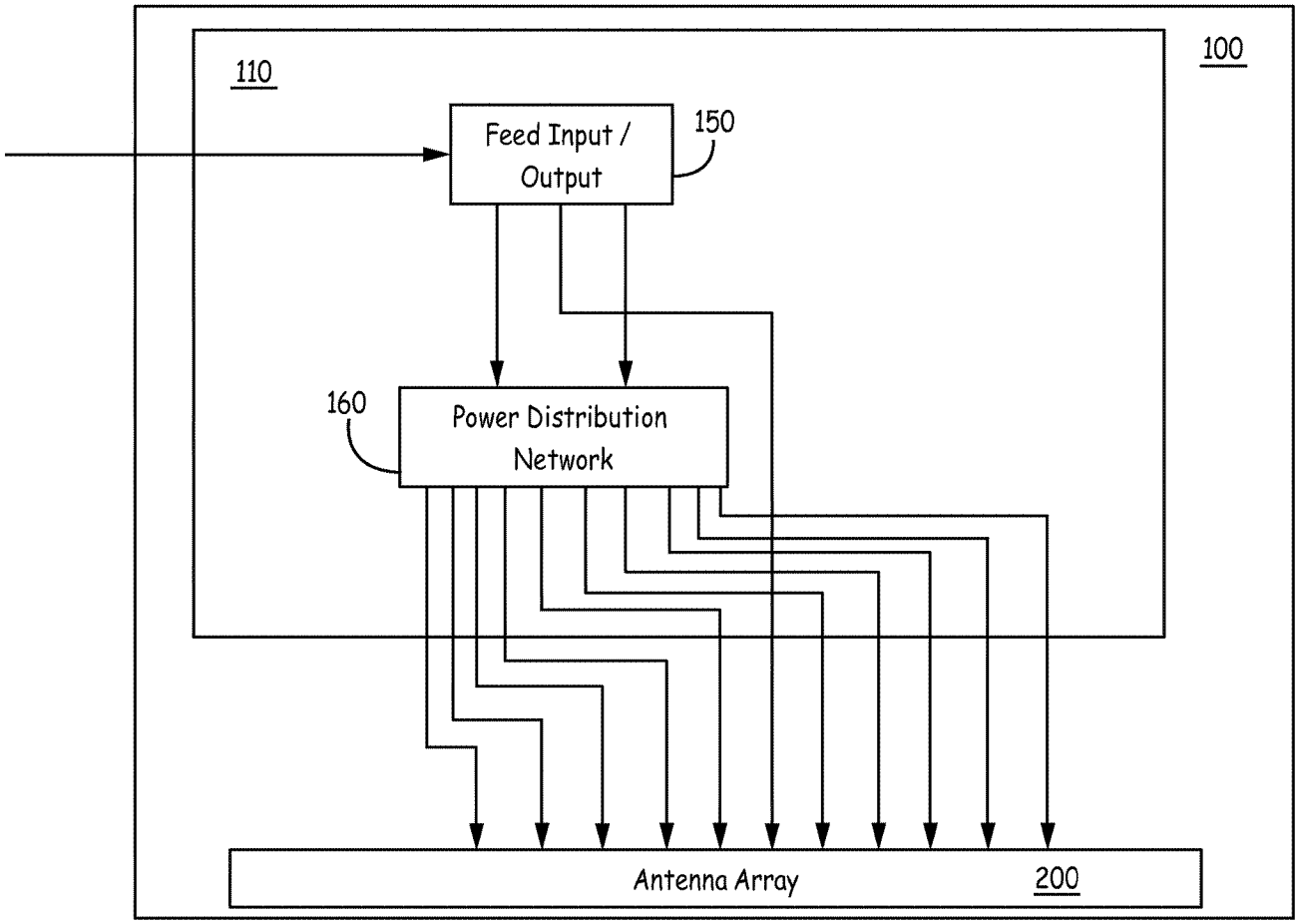
FIG. 1A is a high-level functional block diagram of a feed network and an antenna array according to one embodiment.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

The embodiments described herein relate to apparatus and methodology for feeding a linear antenna array with an integrated stripline feed network. Integrated, in this context, means configured to integrate inside the antenna structure. The integrated stripline feed network provides a stable feed phase while integrated into the antenna structure through electrical and mechanical connections. Integrating the stripline feed network allows the feed network to couple to the linear antenna array without the need for matched length coaxial cables. This significantly decreases the size requirements of a feed network implementation, allowing the feed network to be integrated into the linear antenna array itself. In some embodiments, electrical connections can be made with shorter lengths of coaxial cable from the feed network to the antenna element. The claimed subject matter is described with reference to the drawings, wherein like reference numerals are used to refer to like elements throughout.

FIG. 1A illustrates a high-level functional block diagram of a linear antenna array and integrated stripline feed network system 100 according to one embodiment. The system 100 includes an integrated stripline feed network 110 that feeds an antenna array 200. The feed network 110 includes a feed input/output component 150 that receives the feed signal and initially splits the signal through power distribution units, such as a standard 2-way power divider like the Wilkinson Power Divider, into three output channels. One of the three channels in this example is directly connected to output channel 155-6 of the feed network 110, which provides the most powerful feed signal from the feed input/output component 150. This output channel directly feeds the center antenna element 135 of antenna array 200 in this example. The remaining two output channels feed the left and right side of the antenna array through a power distribution network 160.

Figure 1B:
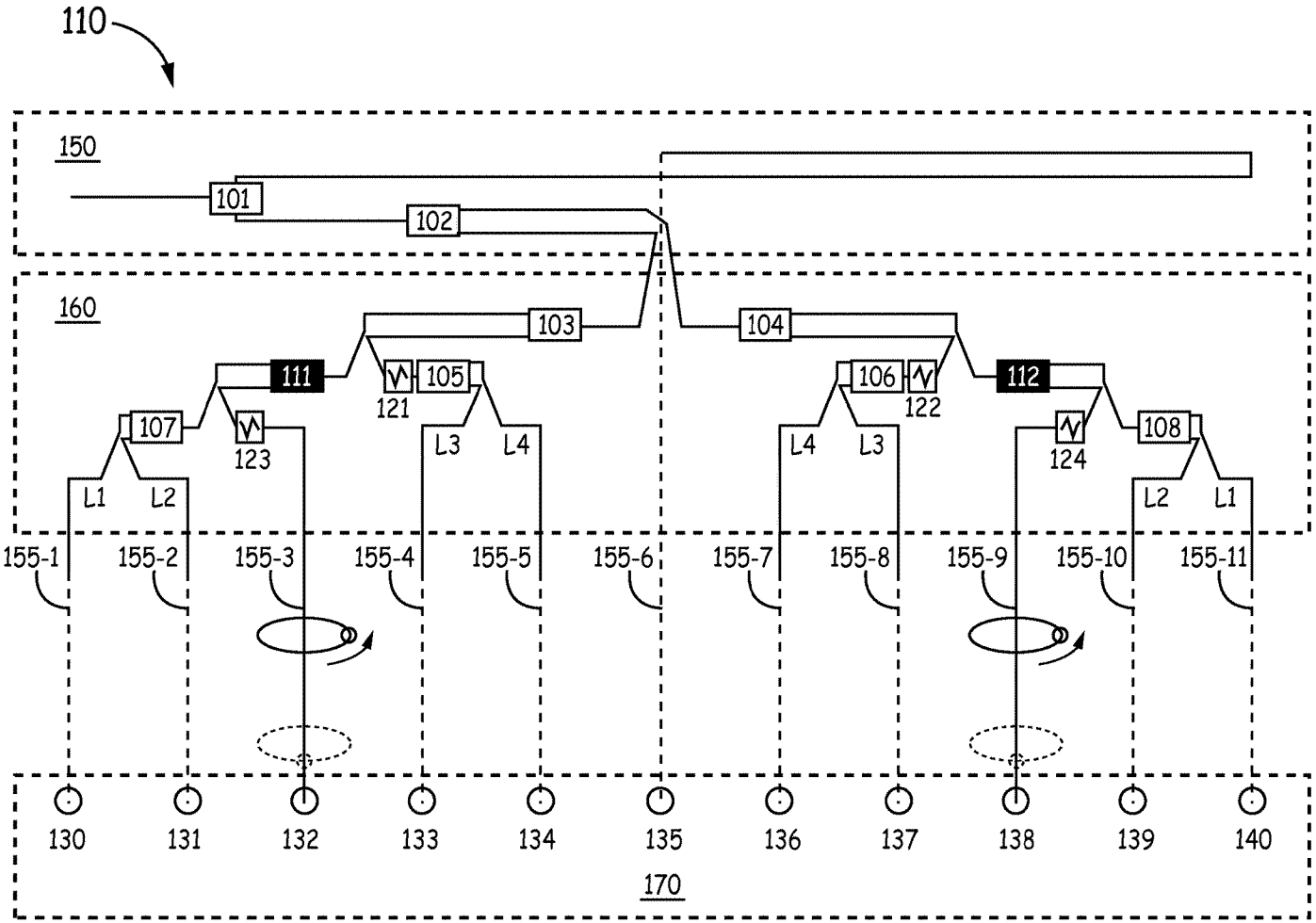
FIG. 1B is a schematic diagram of a feed network according to one embodiment.

FIG. 1B illustrates the circuitry of one embodiment of a feed network 110. The feed network includes a feed input/output component 150, and a power distribution network 160.

With standard directional couplers, the coupled port has a 90 degree phase difference when compared to the through port. A standard directional coupler can be implemented in stripline using coupled quarter wave striplines. The input signal does not undergo a phase change at the through port directly connected to the input port. The coupled port provides a signal that has a 90 degree advanced phase from the through port. The unused port is an isolated port. Standard directional couplers are used for power distribution that is unbalanced (e.g. less than −10 dB for the weaker channel).

Phase delay units are used in some channels to counteract a phase advance caused by a short feed line compared to the other channels. Phase delay units should be able to be used repeatedly with low insertion loss and a low VSWR.

In this embodiment, the feed input/output component 150 includes two 2-way power dividers 101 and 102 to create three output channels. With the 2-way power dividers 101 and 102, the output of both ports of the respective power divider typically have approximately the same phase. In a Wilkinson power divider, the input is coupled to two parallel uncoupled quarter wave transmission lines. The output of each quarter wave line is terminated with a load equal to two times the system impedance. The input and output impedances are equal. The line impedance of the system is equal to the system impedance times the square root of two ($\sqrt{2}Z_0$). Power dividers are used for power distribution that is balanced or only slightly unbalanced (e.g. 0 dB to −10 dB for the weaker channel).

Power divider 101 splits an input signal into two output channels. One output from power divider 101 is coupled to the second power divider 102 and the other output is coupled directly to the center antenna element 135, such that the signal to antenna element 135 has the strongest energy distribution. The output channel coupled to the center antenna element 135 has a line length "L" that is preselected so that a feed phase that is consistent with the other feed channels is maintained. Power divider 102 further divides the output received from the power divider 101 into two more signal channels, one for a left side power distribution network, defined by the network providing a signal for the antenna elements to the left of the center antenna element 135, and one for a right side power distribution network, defined by the network providing a signal to the antenna elements to the right of the center antenna element 135. The output channel for the left side power distribution network is coupled to a power divider 103. The two outputs from power divider 103 are coupled to a directional coupler 111 and phase delay unit 121. Phase delay units, such as phase delay unit 121, are used in some channels to counteract a phase advance caused by a short feed line compared to the other channels. Phase delay units should be able to be used repeatedly with low insertion loss and a low VSWR.

Directional coupler 111 can be implemented with a conventional directional coupler. Conventional directional couplers include a coupled port and a through port. With directional couplers, the coupled port has a 90 degree phase difference when compared to the through port. A standard directional coupler can be implemented in stripline using coupled quarter wave striplines. The input signal does not undergo a phase change at the through port directly connected to the input port. The coupled port provides a signal that has a 90 degree advanced phase from the through port. The unused port is an isolated port. Standard directional couplers are typically used for power distribution that is unbalanced (e.g. less than −10 dB for the weaker channel).

The through port of directional coupler 111 is connected to power divider 107 and the coupled output is connected to phase delay unit 123. The outputs of power divider 107 feed antenna elements 130 and 131. The signal from the coupled port of directional coupler 111 is connected to phase delay unit 123 which adjusts the phase so that it has a phase difference of +90 degrees relative to the signal at antenna elements 130 and 131. In this embodiment, the phase delay unit 123 adjusts the phase for variations in line length of the signal path to antenna elements 130 and 131, and antenna element 132. To adjust for the +90 degree phase advance of antenna element 132, antenna element 132 is spatially rotated counterclockwise, in relation to the direction of signal propagation, by 90 degrees. Phase delay unit 121 is used to adjust the phase of the signal going to antenna elements 133 and 134 so that they are in phase with the feed signal at antenna elements 130, 131, and 132. Then the signal is split by power divider 105, which then feeds the signal to antenna elements 133 and 134. The length of lines L1 and L2 from the outputs of power divider 107 are approximately equal in this example to aid in maintaining the signals to antenna elements 133 and 134 in phase, i.e. L1=L2. The length of lines L3 and L4 from the outputs of power divider 105 are also approximately equal to each other in order to aid in maintaining the signals output from power divider 105 in phase with each other, i.e. L3=L4.

The circuit described above is mirrored for the right side power distribution network. The output channel of power divider 102 for the right side power distribution network is coupled to power divider 104. One of the two outputs from power divider 104 is coupled to a directional coupler 112 and the other output is coupled to phase delay unit 122. The through port of directional coupler 112 is connected to power divider 108 and the output of the coupled port is connected to phase delay unit 124. The outputs of power divider 108 feed antenna elements 139 and 140, respectively. The signal from the coupled port of directional coupler 112 is connected to phase delay unit 124 which adjusts the phase so that it has a phase difference of +90 degrees relative to the signal at antenna elements 139 and 140. To adjust for this phase advance of 90 degrees antenna element 138 is spatially rotated counterclockwise, in relation to the direction of signal propagation, by 90 degrees.

Phase delay unit 122 is used to adjust the phase of the signal going to antenna elements 136 and 137 so that they are in phase with the feed signal at antenna elements 138, 139, and 140. Then the signal output by phase delay unit 122 is split by power divider 106, which then feeds the signal to antenna elements 136 and 137. The length of lines L1 and L2 from the outputs of power divider 108 are equal in this embodiment to aid in maintaining the signals from power divider 108 in phase, i.e. L1=L2. The length of lines L3 and L4 from the outputs of power divider 106 are also equal so that the signals from the output power divider 106 are in phase with each other, i.e. L3=L4. A person having ordinary skill in the art will appreciate that the signals are considered in phase if the difference between the relative phases of the signals is within a predetermined tolerance level depending on the application.

This feed network can be implemented in approximately 2-3 layers of stripline in a multilayered printed circuit board (PCB). The strong and weak signals can be isolated from each other by separating the output channels to the antenna elements in different layers. In one embodiment, the output channel associated with the center antenna element is placed on one layer, while antenna elements 133, 134, 136, 137 with a lower power signal are placed on a different layer of the multilayered PCB. Antenna elements 130, 131, 132, 138, 139, and 140 are placed on another layer of the multilayer PCB.

This multilayered stripline feed network can be mechanically supported such that each antenna element can be more easily soldered or connected and assembled within the support body 205 of the linear antenna array. In some embodiments, multilayered stripline feed network is mechanically supported by being soldered to the support body itself.

Figure 2A:
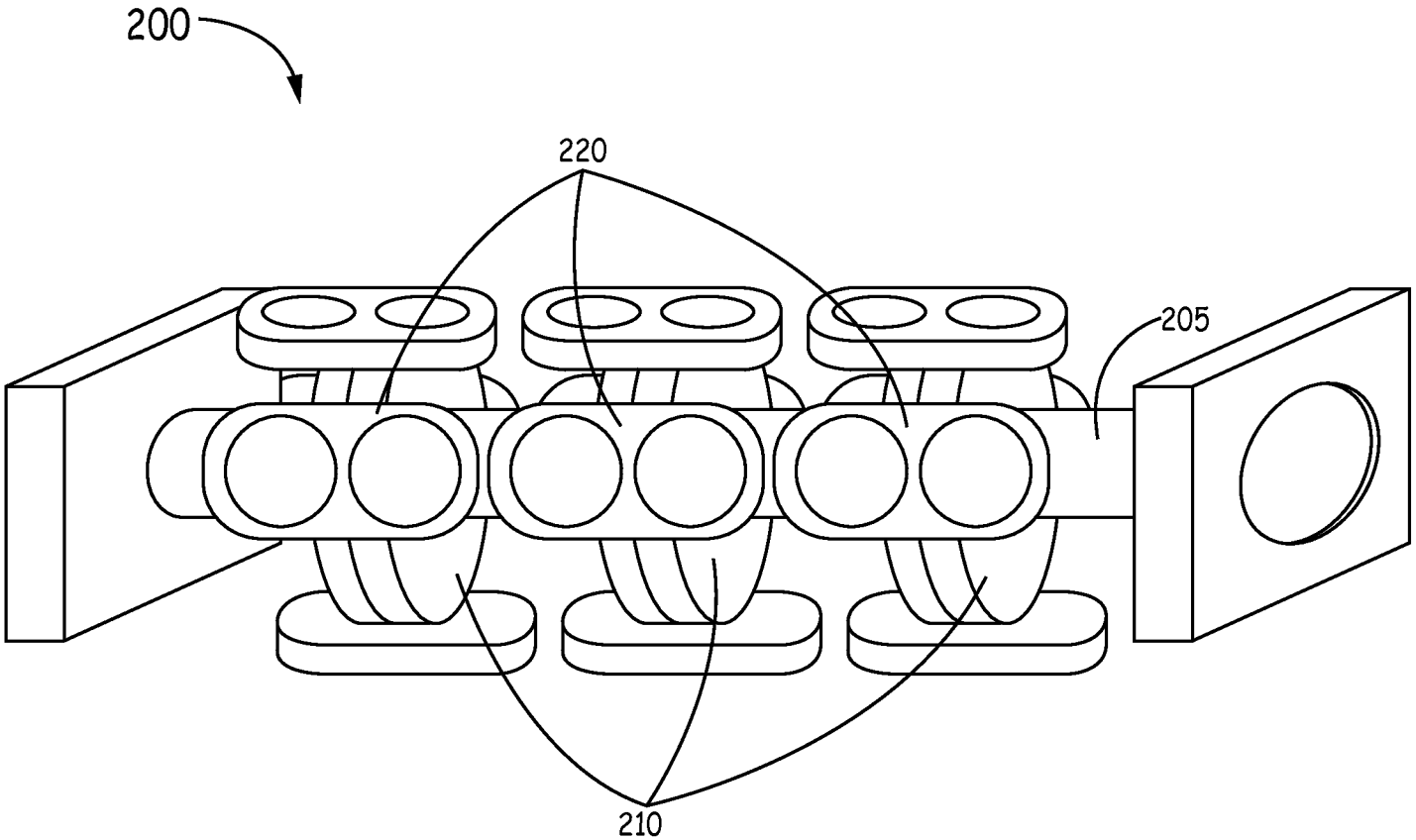
FIG. 2A is a diagram illustrating a 3-bay model with circular radiating elements according to one embodiment.

FIG. 2A illustrates one exemplary embodiment of an antenna array 200 using a 3-bay model. Each of a plurality of circular radiating elements 220 is fed through bays 210. The feed network is integrated into the support body 205, from where the feed signal is fed to bays 210. This allows for a compact, novel, low cost feed system for a linear antenna array.

Figure 2B:
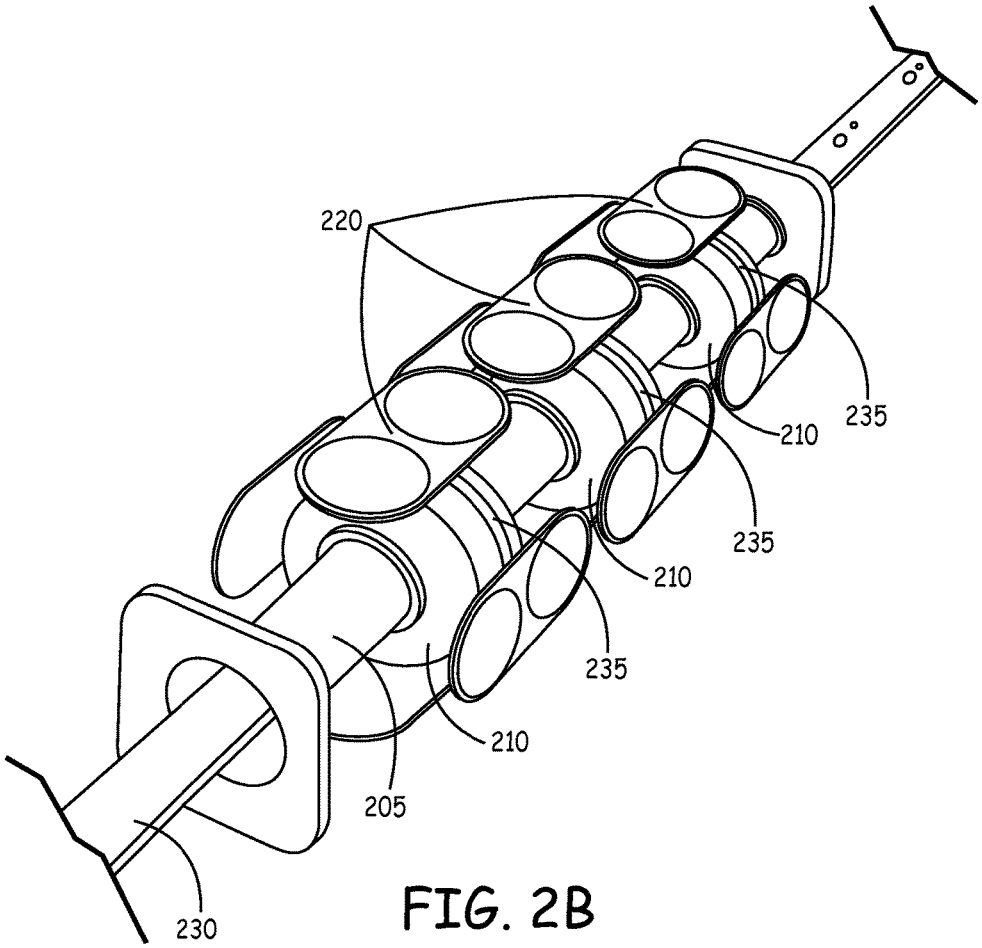
FIG. 2B is a diagram illustrating a perspective view of the 3-bay model with circular radiating elements with an integrated stripline according to one embodiment.

FIG. 2B illustrates a perspective view of one embodiment of an exemplary antenna array with integrated stripline feed lines 230. The stripline feed lines 230 go through the center of support body 205. The feed lines 230 couple to an integrated feed network implemented on a multilayered stripline PCB 235 at each bay 210, upon which radiating elements 220 are mounted. The PCBs 235 are orthogonal relative to the plane of the stripline feed lines 230. A person having ordinary skill in the art will appreciate that the feed lines can connect to the PCBs at each bay through a variety of means for electrically coupling such feed signals. One such example is through the use of coaxial cables. The PCBs 235 can be mechanically supported within the antenna structure through a variety of means. In one embodiment, the PCBs 235 can be supported by soldering to the antenna structure itself.

In some embodiments, the antenna elements 220 are mounted directly on the multilayered PCBs 235, perpendicular to the plane of the PCB. This can be accomplished by mounting the antenna elements, which have slots in them, onto tabs on the PCB 235. Then, the connection can be soldered to create both an electrical and mechanical connection. Other means for mounting the antenna elements to the PCBs 235 can be implemented, such as having a slot in the PCB 235, as opposed to the antenna element 220. In yet another embodiment, the antenna elements 220 are mounted and spaced equally on four sides of the support body, all along one axis as provided by the support body.

Figure 3:
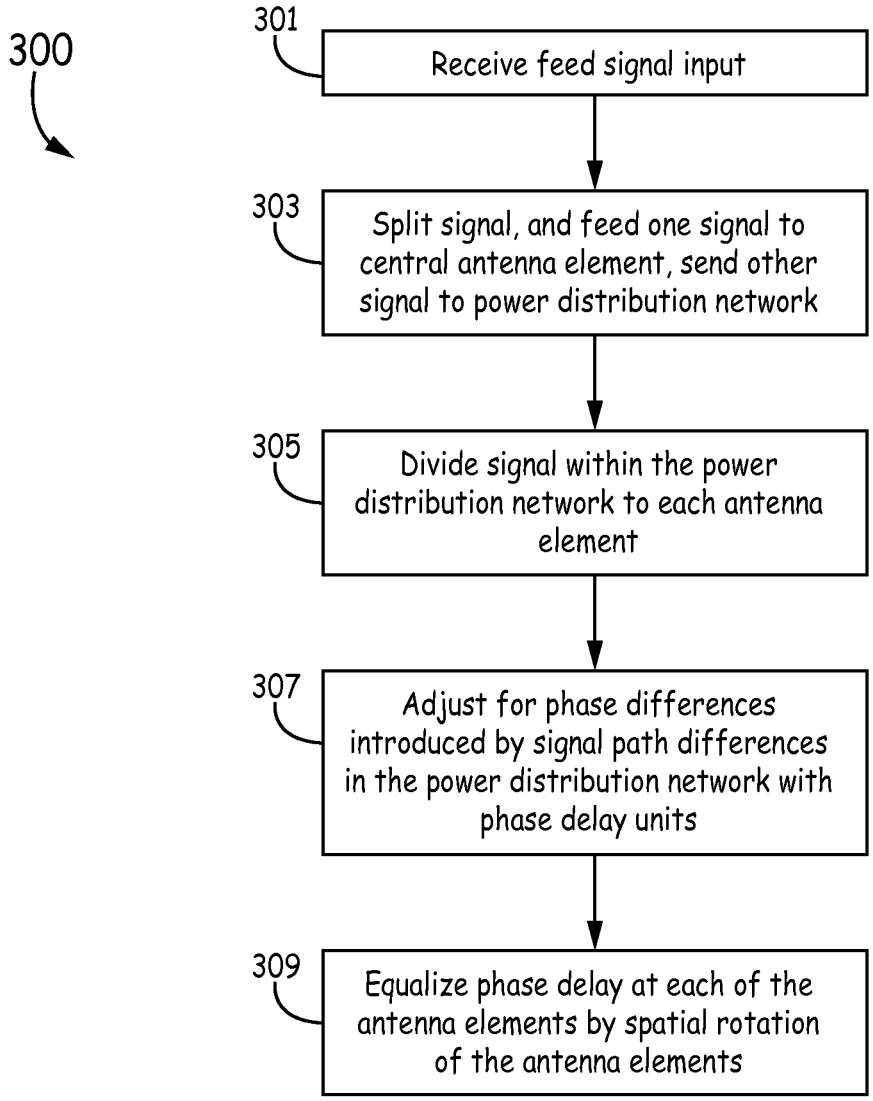
FIG. 3 is an exemplary flow chart illustrating an exemplary method of feeding a signal through an integrated stripline feed network to a linear antenna array.

FIG. 3 is an exemplary flow chart illustrating one embodiment of a method of operating a linear antenna array with an integrated stripline feed network 300. At block 301, a first signal is received by a feed input/output component and split into a second and third signal. At block 303, the second signal is sent directly to a central antenna element, such as the central antenna element discussed above. Then, further splitting of the third signal depends on the number of antenna elements needing a feed signal. If the number of antenna elements is odd, then the third signal is split into a fourth and fifth signal, which are sent to a power distribution network. At block 305, the fourth and fifth signals can be further split into more signals, depending on the how many antenna elements are to be fed a signal. The signals are then output to each of a plurality of output channels. The phase delays introduced to the signals by the varying signal paths are adjusted within the feed network so that the phase delay output at each output channel is approximately matched. At block 307, the feed signals are sent to the antenna elements. At block 309, antenna elements that receive a signal with a phase delay or advancement introduced by the various feed network components are spatially rotated to adjust for the phase delay or advancement.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. An integrated stripline feed network in a linear antenna array, the integrated stripline feed network comprising:

a plurality of bays located along a longitudinal axis of the linear antenna array, each of the bays having a pair of bay portions positioned orthogonal to the longitudinal axis;

a plurality of circuit boards positioned orthogonal to the longitudinal axis, each of the circuit boards respectively interposed between each pair of bay portions, each of the circuit boards implemented with a stripline feed network connected to a plurality of antenna elements in each bay, wherein each stripline feed network comprises:

a power distribution network coupled to the linear antenna array; and a feed signal input/output component coupled to the power distribution network; wherein, the input/output component receives a feed signal and splits the feed signal for distributing to the plurality of antenna elements through the power distribution network;

the integrated stripline feed network configured to be integrated into a support body of the linear antenna array, wherein, the support body structurally supports the linear antenna array;

wherein at least one bay includes antenna elements that have a spatially rotated orientation with respect to other antenna elements of at least one of the other bays to adjust for a respective phase delay or advance, such that the phase of the feed signal received at the spatially rotated antenna elements is matched to the respective phase of the feed signal received at the other antenna elements.

2. The integrated stripline feed network of claim 1, wherein the feed signal input/output component is configured to provide a direct feed signal to a central antenna element of the plurality of antenna elements in each bay, wherein the direct feed signal is a feed signal that has only been split once by the input/output component.

3. The integrated stripline feed network of claim 1, wherein the power distribution network includes one or more Wilkinson power dividers and one or more directional couplers.

4. The integrated stripline feed network of claim 1, wherein the power distribution network includes one or more phase delay units configured to adjust for phase differences in the feed signal due to variations in signal path line length of each of the plurality of antenna elements.

5. The integrated stripline feed network of claim 1, wherein each of the circuit boards comprise a multilayered printed circuit board (PCB).

6. The integrated stripline feed network of claim 5, wherein each multilayered PCB includes three layers of stripline.

7. The integrated stripline feed network of claim 5, wherein the feed signals to each output channel are separated according to signal strength on different layers of the multilayered PCB, wherein stronger signals are separated from weaker signals on different layers of the PCB.

8. A linear antenna array system comprising:

a hollow support body having a longitudinal axis;

a plurality of bays located along the support body, each of the bays having a pair of bay portions that surround respective sections of the support body, each of the bays comprising:

a plurality of antenna elements positioned around the support body; and a circuit board positioned orthogonal to the longitudinal axis of the support body, the circuit board interposed between the pair of bay portions, the circuit board implemented with a stripline feed network connected to the plurality of antenna elements, wherein the stripline feed network is configured to integrate into the support body, the stripline feed network comprising:

a power distribution network configured to distribute a feed signal to each of the plurality of antenna elements; and a feed signal input/output component, coupled to the power distribution network, the input/output component configured to split the feed signal for distributing to the plurality of antenna elements through the power distribution network; and a stripline feed line extending through the support body and electrically connected to each circuit board implemented with the stripline feed network in each of the bays;

wherein at least one of the bays includes antenna elements that have a spatially rotated orientation with respect to other antenna elements of at least one of the other bays to adjust for a respective phase delay or advance, such that the phase of the feed signal received at the spatially rotated antenna elements is matched to the respective phase of the feed signal received at the other antenna elements.

9. The linear antenna array system of claim 8, wherein each circuit board comprises a multilayered printed circuit board (PCB), and the antenna elements of each bay are mounted on the PCB in each respective bay.

10. The linear antenna array system of claim 9, wherein the antenna elements of each bay are fastened orthogonally to a plane formed by a surface of the PCB at each bay.

11. The linear antenna array system of claim 8, wherein the plurality of bays comprises three bays.

12. The linear antenna array system of claim 8, wherein the plurality of circular antenna elements in each bay is coupled on each of four sides of each respective bay.

13. The linear antenna array system of claim 8, wherein the circuit board in each bay is mechanically and electrically coupled to the support body.

14. The linear antenna array system of claim 13, wherein the circuit board in each bay is mechanically coupled by soldering.

15. The linear antenna array system of claim 8, wherein each of the plurality of antenna elements has a racetrack oval shaped surface.

16. The linear antenna array system of claim 15, wherein each of the plurality of antenna elements include a pair of radiator discs on the racetrack oval shaped surface.

* * * * *